US012655549B2

(12) United States Patent
Kato et al.

(10) Patent No.: US 12,655,549 B2
(45) Date of Patent: Jun. 16, 2026

(54) HIGHLY STRETCHABLE WOVEN FABRIC

(71) Applicant: KOWA COMPANY, LTD., Aichi (JP)

(72) Inventors: Katsutoshi Kato, Aichi (JP); Satoshi Kumabe, Aichi (JP)

(73) Assignee: Kowa Company, Ltd., Nagoya (JP)

( * ) Notice: Subject to any disclaimer, the term of this patent is extended or adjusted under 35 U.S.C. 154(b) by 333 days.

(21) Appl. No.: 18/255,500

(22) PCT Filed: Dec. 3, 2021

(86) PCT No.: PCT/JP2021/044444

§ 371 (c)(1),
(2) Date: Dec. 12, 2023

(87) PCT Pub. No.: WO2022/118949

PCT Pub. Date: Jun. 9, 2022

(65) Prior Publication Data

US 2025/0361655 A1 Nov. 27, 2025

(30) Foreign Application Priority Data

Dec. 4, 2020 (JP) ..... 2020-201810

(51) Int. Cl.
*D03D 15/56* (2021.01)
*D03D 13/00* (2006.01)
(Continued)

(52) U.S. Cl.
CPC ..... *D03D 13/004* (2013.01); *D03D 15/217* (2021.01); *D03D 15/283* (2021.01);
(Continued)

(58) Field of Classification Search
CPC .. D03D 13/004; D03D 15/217; D03D 15/283; D03D 15/56; D10B 2201/02;
(Continued)

(56) References Cited

U.S. PATENT DOCUMENTS 6,918,413 B2 * 7/2005 Ono ..... D03D 15/56 442/214
10,751,211 B2 * 8/2020 Tsuchiya ..... A61F 13/061
(Continued)

FOREIGN PATENT DOCUMENTS

CH 497570 A 10/1970
CN 102304802 A 1/2012
(Continued)

OTHER PUBLICATIONS

International Search Report issued in International Application No. PCT/JP2021/044444, mailed on Feb. 8, 2022.
(Continued)

*Primary Examiner* — Robert H Muromoto, Jr.
(74) *Attorney, Agent, or Firm* — Knobbe, Martens Olson & Bear, LLP

(57) ABSTRACT

A stretchable woven fabric possessing flexibility, and having high stretchability and a high stretch recovery ratio in a weft direction and a bias direction. The stretchable woven fabric has a multiple weave structure. The multiple weave structure is a weave structure in which a tricot weave structure, which is a double warp weave having a ridge pattern in a warp direction, and a weft-backed structure, are combined with common warp so that wefts of both structures are disposed alternately in a certain arrangement. The number of floats of wefts configuring the weft-backed structure is 3 or more relative to the warp.

15 Claims, 4 Drawing Sheets

(51) Int. Cl.
*D03D 15/217* (2021.01)
*D03D 15/283* (2021.01)
*D03D 15/00* (2021.01)

(52) U.S. Cl.
CPC ..... *D03D 15/56* (2021.01); *D10B 2201/02* (2013.01); *D10B 2331/10* (2013.01); *D10B 2501/00* (2013.01); *D10B 2505/00* (2013.01); *D10B 2509/00* (2013.01)

(58) Field of Classification Search
CPC ..... D10B 2331/10; D10B 2501/00; D10B 2505/00; D10B 2509/00
See application file for complete search history.

(56) References Cited

U.S. PATENT DOCUMENTS

| | | | | |
|---|---|---|---|---|
| 11,708,650 | B2 * | 7/2023 | Wang | D03D 15/47 139/384 R |
| 2003/0066571 | A1 * | 4/2003 | Ono | D03D 15/54 139/421 |
| 2010/0285274 | A1 * | 11/2010 | Fukunaga | D03D 15/283 428/141 |
| 2012/0207955 | A1 * | 8/2012 | Ogata | D04B 1/12 428/221 |
| 2013/0048140 | A1 * | 2/2013 | Yenici | D03D 17/00 139/421 |
| 2022/0408864 | A1 * | 12/2022 | Tanaka | D03D 15/533 |
| 2023/0295841 | A1 * | 9/2023 | Kim | C08G 63/85 428/369 |

FOREIGN PATENT DOCUMENTS

| | | | |
|---|---|---|---|
| FR | 2687172 | A1 | 8/1993 |
| JP | S47-041996 | Y1 | 12/1972 |
| JP | 3863749 | B2 | 12/2006 |
| JP | 6018337 | B2 | 11/2016 |
| JP | 6033087 | B2 | 11/2016 |
| JP | 2018-127743 | A | 8/2018 |
| WO | WO 2009/094311 | A2 | 7/2009 |

OTHER PUBLICATIONS

"The Ministry of Education", Weave Structure Revised Edition, Feb. 25, 1969, p. 87-88 4th. Tricot weave, Fig. 4-58 E.
Office Action issued in CN Application No. 202180018705.4, dated Mar. 13, 2023.
Submission Form for Publication in JP Application No. 2020-201810, dated Mar. 9, 2023.
Extended European Search Report for EP Appl. No. 21900698.8, dated Nov. 27, 2024 (in 8 pages).
Indian Office Action for Indian App. No. 202317043768, dated Mar. 27, 2026 (in 8 pages).

* cited by examiner

HIGHLY STRETCHABLE WOVEN FABRIC

TECHNICAL FIELD

The present invention relates to a stretchable woven fabric possessing a bulky feel (puffy feel) and flexibility, and having a high stretch ratio and a stretch recovery ratio in a weft direction and a bias direction.

BACKGROUND ART

Conventionally, while the stretchable woven fabrics for clothing have been used for thin and/or thick woven fabrics, their stretchability solely relied on elastic fibers. When attempting to give the fabric a bulky feel, the stretchability of the fabric was sacrificed, and when attempting to give the fabric a high stretch ratio (high stretchability), the puffy feel of the fabric was sacrificed, and further improvement is demanded in clothing fabrics capable of achieving both a bulky feel and stretchability.

Patent Document 1 discloses a stretchable woven fabric having an appearance like a woven fabric in which stiff yarns are used as the warps, stiff yarns and elastic yarns are alternately arranged as the wefts, and the stiff yarns of the wefts are woven over 6 to 24 warps in a state where tension is applied to the elastic yarns, whereby the stiff yarns are caused to bend and form a loop pursuant to the shrinkage of the elastic yarns upon subsequently returning to the normal tension. Nevertheless, since the fabric thickness was thin and the stretchability was also limited to the length of the yarns of the formed loop part, the stretchability was insufficient.

Patent Document 2 discloses stretchable double warp weave denim in which warps are woven in double layers on the front and back, wefts are woven in a single layer, and elastic fiber filaments are used. Nevertheless, while a bulky feel can be obtained with a double warp weave, the front and back structures are either a twill weave structure or a satin weave structure, and the stretch ratio was insufficient.

Patent Document 3 discloses a woven fabric for competition swimwear in which elastic yarns are used as the warps and wefts, and a plain weave portion and a double weave portion are alternately repeated. With this woven fabric, the plain weave portion is concave and the double weave portion is convex, and, by arranging this concavo-convex part in stripes in parallel to the advancing direction of the body in the water, it is possible to alleviate the friction coefficient with the water flow, and high stretchability can also be obtained. Nevertheless, with a woven fabric in which the plain weave portion is thin and the double weave portion is thick, it is difficult to obtain a bulky feel of the fabric as a whole, and it cannot be said that this is a general-purpose woven fabric suitable for general clothing items.

PRIOR ART DOCUMENTS

Patent Documents

[Patent Document 1] Japanese Patent No. 6033087

[Patent Document 2] Japanese Patent No. 3863749

[Patent Document 3] Japanese Patent No. 6018337

SUMMARY OF THE INVENTION

Problems to be Solved by the Invention

An object of the present invention is to provide a woven fabric possessing flexibility, and having a high stretch ratio and a high stretch recovery ratio in a weft direction and a bias direction.

Means for Solving the Problems

As a result of intense study, the present inventors discovered that a double warp weave structure in which the front-side warps and the back-side warps are alternately disposed in a certain arrangement and the floats and depressions of the warps are arranged to be in reverse at the boundary position of the front and back structure; that is, by realizing a woven fabric having a structure backed with wefts so that a tricot weave structure having a ridge pattern in a warp direction will additionally have three or more floats and depressions in a weft direction in a certain warp arrangement, it is possible to obtain a woven fabric possessing flexibility when stretched and having a high stretch ratio and a stretch recovery ratio in a weft direction and a bias direction, and thereby completed the present invention.

The present invention may include the following.

[1] A stretchable woven fabric having a multiple weave structure, wherein the multiple weave structure is a weave structure in which a tricot weave structure, which is a double warp weave having a ridge pattern in a warp direction, and a weft-backed structure, are combined with common warp so that wefts of both structures are disposed alternately in a certain arrangement; and a number of floats of wefts configuring the weft-backed structure is 3 or more relative to the warp.

[2] The stretchable woven fabric according to [1] above, wherein the weft-backed structure is a broken twill weave or a satin weave.

[3] The stretchable woven fabric according to [1] or [2] above, wherein the number of floats of wefts configuring the weft-backed structure is 15 or less.

[4] The stretchable woven fabric according to any one of [1] to [3] above, wherein the weft is elastic yarn.

[5] The stretchable woven fabric according to any one of [1] to [4] above, wherein the stretchable woven fabric has a stretch ratio of 35% or more.

[6] A clothing item comprising the stretchable woven fabric according to any one of [1] to [5] above.

[7] A hygiene material comprising the stretchable woven fabric according to any one of [1] to [5] above.

[8] A daily life material comprising the stretchable woven fabric according to any one of [1] to [5] above.

[9] An industrial material comprising the stretchable woven fabric according to any one of [1] to [5] above.

Effect of the Invention

Since the woven fabric of the present invention possesses flexibility, and has a high stretch ratio and a high stretch recovery ratio in a weft direction and a bias direction, it is possible to provide a woven fabric having a knit texture. Moreover, in a preferred embodiment, it is possible to provide the woven fabric with a bulky feel (puffy feel).

DESCRIPTION OF EMBODIMENTS

Figure 1:
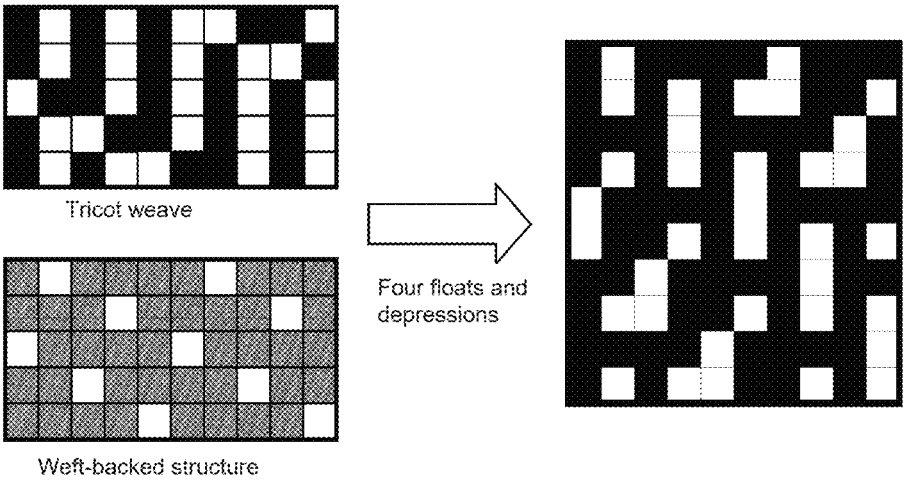
FIG. 1 The figure is a structural diagram of the fabric woven in Example 1.

The present invention is now explained in detail. Nevertheless, the present invention is not limited to the following embodiments, and may be freely modified within the scope of the present invention.

One aspect of the present invention is a stretchable woven fabric having a multiple weave structure, wherein the multiple weave structure is a weave structure in which a tricot weave structure, which is a double warp weave having a ridge pattern in a warp direction, and a weft-backed structure, are combined with common warp so that wefts of both structures are disposed alternately in a certain arrangement, and a number of floats of wefts configuring the weft-backed structure is 3 or more relative to the warp.

(Materials that can be Used for the Woven Fabric of this Embodiment)

There is no particular limitation to the materials of the warps that can be used in this embodiment, and natural fibers or chemical fibers can be used. As natural fibers, vegetable fibers such as cotton, hemp and kapok, and animal fibers such as silk, wool, goat hair, llama hair, camel hair, rabbit hair, horse hair and cow hair can be used. As chemical fibers, regenerated fibers such as rayon, cupra and polynosic, semisynthetic fibers such as acetate, triacetate and promix, synthetic fibers such as polyester, polyamide, polyvinyl alcohol, polyacrylonitrile, polyethylene, polypropylene, polystyrene and polyurethane, metal fibers, carbon fibers, glass fibers, Japanese paper and other types of fibers can be used. Furthermore, natural rubber or synthetic rubber can also be used as the materials. From the perspective of texture when used for clothing items, natural fibers are preferably used, and vegetable fibers such as cotton and hemp are particularly preferable.

As the thickness of the warps, while yarns having the desired thickness may be suitably used, as the warp diameter, yarns having a 1 to 300 cotton count based on cotton count conversion can be used, and yarns having a 10 to 120 cotton count are preferably used, and yarns having a 20 to 80 cotton count are more preferably used.

There is no particular limitation to the materials of the wefts that can be used in this embodiment, and natural fibers or chemical fibers can be used. As natural fibers, vegetable fibers such as cotton, hemp and kapok, and animal fibers such as silk, wool, goat hair, llama hair, camel hair, rabbit hair, horse hair and cow hair can be used. As chemical fibers, regenerated fibers such as rayon, cupra and polynosic, semisynthetic fibers such as acetate, triacetate and promix, synthetic fibers such as polyester, polyamide, polyvinyl alcohol, polyacrylonitrile, polyethylene, polypropylene, polystyrene and polyurethane can be used. Furthermore, natural rubber or synthetic rubber can also be used as the materials.

As the thickness of the wefts, while yarns having the desired thickness may be suitably used, as the weft diameter, yarns having a 1 to 300 cotton count based on cotton count conversion can be used, and yarns having a 10 to 120 cotton count are preferably used, and yarns having a 20 to 80 cotton count are more preferably used.

The weft and/or warp used in this embodiment are preferably elastic yarns containing elastic fibers having stretchability or crimped yarns to provide high stretchability. As specific elastic fibers, used may be polyurethane fibers, polytrimethylene terephthalate (PTT) fibers, polytributylene terephthalate (PBT) fibers, natural rubber, synthetic rubber and the like. These elastic fibers may be directly used as filaments or spun yarns, or as textured yarns by being combined with non-elastic fiber materials. As textured yarns, used may be core spun yarns (CSY) having elastic fiber filaments as their core and in which short fibers are arranged around the core, air covered yarns (ACY) or filament twisted yarns (FTY) in which elastic fiber filaments and synthetic fibers are interlaced or twisted, single covered yarns (SCY), double covered yarns (DCY) and the like, and all of these can be preferably used. Moreover, as specific crimped yarns, used may be those in which woolly finish, buleria finish, Italian finish, knit de knit finish, indentation, composite false twist finish, Taslan finish, or interlacing is performed to materials such as nylon filaments, polytrimethylene terephthalate (PTT) filaments, polytributylene terephthalate (PBT) filaments, and polyethylene terephthalate (PET) filaments, or composite fibers in which types of polymers are combined side-by-side, and all of these can be preferably used.

(Weave Structure of this Embodiment)

The woven fabric of this embodiment has a multiple weave structure. A multiple weave fabric is a woven fabric in which two or more woven fabrics are layered, and the woven fabric of this embodiment has a weave structure in which a tricot weave structure, which is a double warp weave having a ridge pattern in a warp direction, and a weft-backed structure, are combined with common warp so that wefts of both structures are disposed alternately in a certain arrangement.

As a tricot weave, there are a double warp weave and a double weft weave, and this embodiment is a double warp weave structure in which the front-side warps and the back-side warps are alternately disposed in a certain arrangement and the floats and depressions of the warps are arranged to be in reverse at the boundary position of the front and back structure. The warps of the front structure and the warps of the back structure may be alternately disposed for every 1 to 3 warps, and preferably adopted is a structure in which one back warp is alternately disposed with one front warp, or a structure in which two back warps are alternately disposed with two front warps.

A weft-backed structure is a structure of backing up the foregoing tricot weave structure with wefts, and the structure is backed up with wefts so that the structure will have three or more floats and depressions in a weft direction in a certain warp arrangement. In this embodiment, as a result of the number of floats of wefts configuring the backed structure being 3 or more relative to the warp configuring the tricot weave structure, it is possible to realize a woven fabric having high stretchability and flexibility based on the combination of the stretchability derived from the configuration of the tricot weave structure as a double warp weave structure, and the stretchability resulting from the number of floats of wefts configuring the backed structure being 3 or more relative to the warp arrangement configuring the tricot weave structure. While there is no particular limitation to the number of floats of wefts relative to the warp arrangement, it is normally 15 or less, and may be 11 or less, 7 or less, and even 5 or less.

So as long as the number of floats of wefts configuring the backed structure is 3 or more relative to the warp arrangement configuring the tricot weave structure, there is no particular limitation to the weft-backed structure, but from the perspective of favorable stretchability, a broken twill weave or a satin weave is preferred.

The broken twill weave includes a four-yarn broken twill weave, and a 3/1-yarn broken twill weave is preferably used.

The satin weave includes a five-yarn satin weave to sixteen-yarn satin weave or a broken structure thereof, and a five-yarn satin weave to twelve-yarn satin weave or a broken structure is preferably used.

With the stretchable woven fabric of the present invention, since the wefted structure and the tricot weave structure use common warp, the number of warps of the wefted structure and the number of warps of the tricot weave structure upon combination are preferably the same.

Furthermore, while the stretchable woven fabric of the present invention has a structure in which wefts configuring the tricot weave structure and the wefts configuring the weft-backed structure are combined with common warp so that wefts of both structures are disposed alternately in a certain arrangement, preferably adopted is a weave structure in which the wefts configuring the tricot weave structure and the wefts configuring the weft-backed structure are combined alternately in an arrangement of 1:1, 1:2, 2:1, or 2:2.

(Manufacturing Method of Woven Fabric of this Embodiment)

Explanation of looms that can be used:

While there is no particular limitation to the loom so as long as it can weave the stretchable woven fabric structure of this embodiment, the stretchable woven fabric structure of this embodiment can be manufactured according to conventional methods by using a dobby machine or a jacquard machine with 16 frames such as a rapier loom, air jet loom, water jet loom, or Sulzer loom.

Post-processing that can be performed:

The stretchable woven fabric structure of this embodiment may also be subject to various types finishing as needed. As the finishing process, performed may be dyeing, raising, shearing, mercerization, buffing, bleaching, heat setting, pleating and the like.

(Measurement Method of Fabric Characteristics)

The stretchable woven fabric of this embodiment has a high stretch ratio and a high stretch recovery ratio in a weft direction and a bias direction. Specifically, the stretchable woven fabric preferably has, in the weft direction and/or bias direction, a stretch ratio of 35% or more, more preferably 40% or more, and most preferably 50% or more. There is no particular limitation to the upper limit of the stretch ratio, and it is normally 100% or less, and may also be 90% or less.

Furthermore, the stretchable woven fabric preferably has, in the weft direction and/or bias direction, a stretch recovery ratio of 70% or more, more preferably 75% or more, and most preferably 80% or more. There is no particular limitation to the upper limit of the stretch recovery ratio, and it is normally 100% or less, and may also be 95% or less.

The stretch ratio can be measured according to the JIS-L1096B method (constant load method), and the stretch recovery ratio can be measured according to the JIS-L1096B-1 method (constant load method).

While there is no particular limitation to the basis weight of the stretchable woven fabric of this embodiment, from the perspective of providing a bulky feel, the basis weight is preferably 50 g/m$^2$ or more, and more preferably 200 g/m$^2$ or more. There is no particular limitation to the upper limit of the basis weight, but it is normally 1000 g/m$^2$ or less, and may also be 600 g/m$^2$ or less.

The thickness of the stretchable woven fabric of this embodiment can be suitably set according to the situation of using the woven fabric. The thickness is normally 0.5 mm or more and preferably 0.6 mm or more, and is normally 3 mm or less and preferably 2 mm or less. While the thickness of the stretchable woven fabric is measured using a thickness gauge (dial thickness gauge), the thickness is measured according to the JIS-L1096A method (JIS method).

Since the stretchable woven fabric of this embodiment possesses flexibility, and has a high stretch ratio and a stretch recovery ratio in a weft direction and a bias direction, it can be suitably used for various clothing items, hygiene materials, daily life materials or industrial materials. As suitable examples of clothing items to which the stretchable woven fabric of this embodiment can be applied, there are pants and bottoms such as jeans, slacks and skirts, outerwear such as jackets, blousons, coveralls and coats, innerwear such as T-shirts, shirts and blouses, dresses, overalls, salopettes and the like. As suitable examples of hygiene materials to which the stretchable woven fabric of this embodiment can be applied, there are taping tapes, poultices, bandages, masks, supporters and the like. As suitable examples of daily life materials to which the stretchable woven fabric of this embodiment can be applied, there are interior products such as sofa covers and cushion covers, and bedding items such as bed sheets, duvay covers and pillow covers, and as suitable examples of industrial material to which the stretchable woven fabric of this embodiment can be applied, there are car seats.

EXAMPLES

The present invention is now explained in further detail based on the following Examples, but the scope of the present invention is not limited to these Examples.

Example 1

Cotton yarns (combed yarns) having a 20 cotton count were used as the warps, core spun yarns having a 30 cotton count using cored yarn 40-denier polyurethane filaments and core spun yarns having a 40 cotton count using cored yarn 40-denier polyurethane filaments were alternately arranged at a ratio of 1:1 and used as the wefts, the warps and wefts were woven with an air jet loom so that there will be 82 warps per inch and 50+50 wefts per inch in the weave structure shown in FIG. 1, and a gray fabric of a 71-inch-wide highly stretchable woven fabric (mixture ratio C:PU=95:5) was obtained.

The obtained gray fabric was subject to a regular finish with continuous dyeing using reactive dyes, and a highly stretchable woven fabric 1 was obtained.

Example 2

Figure 2:
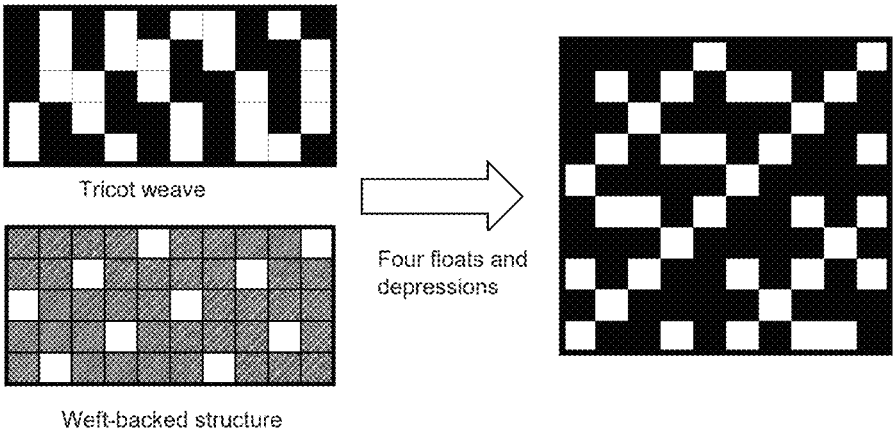
FIG. 2 The figure is a structural diagram of the fabric woven in Example 2.

Cotton yarns (combed yarns) having a 20 cotton count were used as the warps, core spun yarns having a 30 cotton count using cored yarn 40-denier polyurethane filaments and core spun yarns having a 40 cotton count using cored yarn 40-denier polyurethane filaments were alternately arranged at a ratio of 1:1 and used as the wefts, the warps and wefts were woven with an air jet loom so that there will be 82 warps per inch and 50+50 wefts per inch in the weave structure shown in FIG. 2, and a gray fabric of a 71-inch-wide highly stretchable woven fabric (mixture ratio C:PU=95:5) was obtained.

The obtained gray fabric was subject to a regular finish with continuous dyeing using reactive dyes, and a highly stretchable woven fabric 2 was obtained.

Example 3

Figure 3:
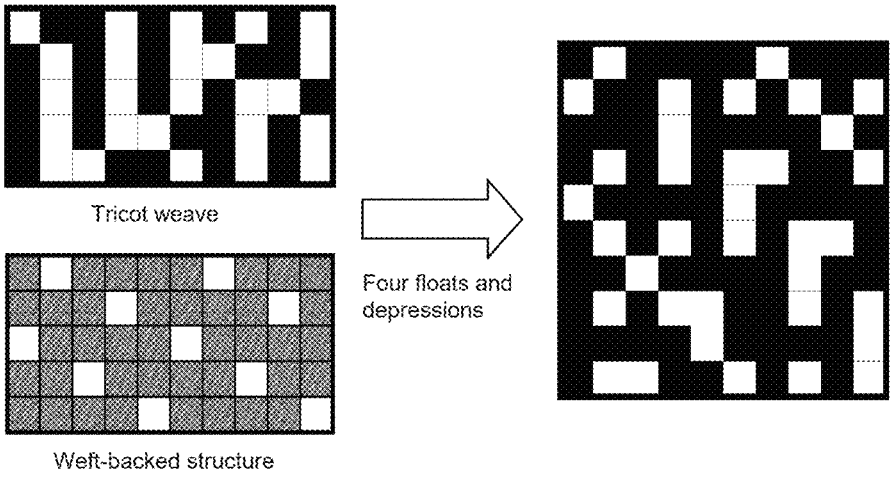
FIG. 3 The figure is a structural diagram of the fabric woven in Example 3.

Cotton yarns (combed yarns) having a 20 cotton count were used as the warps, core spun yarns having a 40 cotton count using cored yarn 40-denier polyurethane filaments were used as the wefts, the warps and wefts were woven with an air jet loom so that there will be 82 warps per inch and 100 wefts per inch in the weave structure shown in FIG. 3, and a gray fabric of a 71-inch-wide highly stretchable woven fabric (mixture ratio C:PU=95:5) was obtained.

The obtained gray fabric was subject to a regular finish with continuous dyeing using reactive dyes, and a highly stretchable woven fabric 3 was obtained.

Example 4

Figure 4:
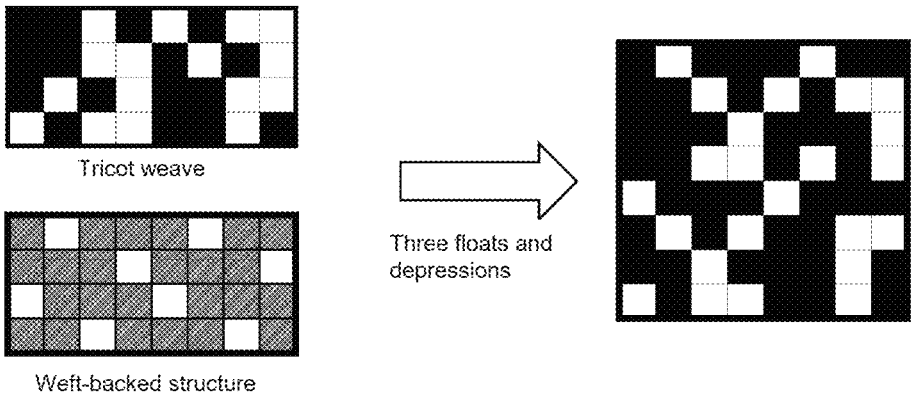
FIG. 4 The figure is a structural diagram of the fabric woven in Example 4.

Cotton yarns (compact yarns) having a 60 cotton count were used as the warps, core spun yarns having a 40 cotton count using cored yarn 40-denier polyurethane filaments were used as the wefts, the warps and wefts were woven with an air jet loom so that there will be 160 warps per inch and 100 wefts per inch in the weave structure shown in FIG. 4, and a gray fabric of a 71-inch-wide highly stretchable woven fabric (mixture ratio C:PU=95:5) was obtained.

The obtained gray fabric was subject to a regular finish with continuous dyeing using reactive dyes, and a highly stretchable woven fabric 4 was obtained.

Comparative Example 1

Cotton yarns (carded yarns) having a 20 cotton count were used as the warps, core spun yarns having a 20 cotton count using cored yarn 117-denier polyurethane filaments were used as the wefts, the warps and wefts were woven with an air jet loom so that there will be 100 warps per inch and 65 wefts per inch, and the overall width of the woven fabric will be 71 inches in an upward-left 3/1 twill weave (3/1 L), and a stretchable fabric 5 (mixture ratio C:PU=96:4) subject to a regular finish with continuous dyeing using reactive dyes and mercerization using liquid ammonia was obtained.

Comparative Example 2

Cotton yarns (compact yarns) having a 30 cotton count were used as the warps, core spun yarns having a 16 cotton count using cored yarn 117-denier polyurethane filaments were used as the wefts, the warps and wefts were woven with an air jet loom so that there will be 124 warps per inch and 74 wefts per inch, and the overall width of the woven fabric will be 68 inches in a weave structure 3/2//irregular dobby weave, and a stretchable fabric 6 (mixture ratio C:PU=97:3) subject to a regular finish with continuous dyeing using reactive dyes was obtained.

Test Example

The stretch ratio (%), stretch recovery ratio (%), flexibility and fabric thickness (mm) of the highly stretchable woven fabrics 1 to 3 obtained in Examples 1 to 3 and the stretchable fabrics 5 and 6 obtained in Comparative Examples 1 and 2 were respectively measured, and the results are summarized in Table 1.

The flexibility criteria is as follows.

○: Stretches easily even with little effort.

Δ: Slightly stiff when stretched.

x: Stiff when stretched.

TABLE 1

| | Stretch ratio (%) | Stretch recovery ratio (%) | Flexibility | Fabric thickness (mm) | Basis weight (g/m$^2$) |
|---|---|---|---|---|---|
| Example 1 | 83.0 | 84.0/88.6 | ○ | 0.73 | 400 |
| Example 2 | 49.0 | 82.7/87.5 | ○ | 0.69 | 365 |
| Example 3 | 73.0 | 82.1/88.3 | ○ | 0.53 | 315 |
| Comparative Example 1 | 31.5 | 75.8/83.3 | Δ | 0.50 | 270 |
| Comparative Example 2 | 29.5 | 74.2/87.1 | Δ | 0.50 | 280 |

According to Table 1, Examples 1 to 3 were all able to obtain a woven fabric structure having a stretch ratio exceeding 40% and a stretch recovery ratio also exceeding 80%, and exhibited stretchability superior to the so-called high-power stretch structures of Comparative Examples 1 and 2, and also yielded flexibility in which the woven fabric can be stretched easily with little effort. Furthermore, the woven fabrics of Examples 1 to 4 are double weave fabrics, and were suitable for use as fabrics for clothing items with a knit texture while offering a bulky and luxurious feel.

What is claimed is:

1. A stretchable woven fabric having a multiple weave structure, wherein the multiple weave structure is a weave structure in which a tricot weave structure and a weft-backed structure are combined with common warp so that wefts of both structures are disposed alternately in a certain arrangement; and a number of floats of wefts configuring the weft-backed structure is 3 or more relative to the warp;

wherein the weft is an elastic yarn, wherein the tricot weave structure is a double warp weave structure in which the front-side warps and the back-side warps are alternately disposed in a certain arrangement and floats and depressions of the front-side and back-side warps are arranged to be in reverse at a boundary position of the front-side and back-side warps.

2. The stretchable woven fabric according to claim 1, wherein the weft-backed structure is a broken twill weave or a satin weave.

3. The stretchable woven fabric according to claim 1, wherein the number of floats of wefts configuring the weft-backed structure is 15 or less.

4. The stretchable woven fabric according to claim 1, wherein the stretchable woven fabric has a stretch ratio of 35% or more.

5. A clothing item comprising the stretchable woven fabric according to claim 1.

6. A hygiene material comprising the stretchable woven fabric according to claim 1.

7. A daily life material comprising the stretchable woven fabric according to claim 1.

8. An industrial material comprising the stretchable woven fabric according to claim 1.

9. The clothing item according to claim 5, which is selected from the group consisting of pants, bottoms, outerwear, innerwear, a dress, overalls, and a salopette.

10. The stretchable woven fabric according to claim 1, wherein the tricot weave structure is a double warp weave structure having a ridge pattern in a warp direction.

11. The stretchable woven fabric according to claim 1, wherein the stretchable woven fabric has a stretch recovery ratio of 70% or more.

12. The stretchable woven fabric according to claim 1, wherein the stretchable woven fabric has a basis weight of 50 $g/m^2$ or more.

13. The stretchable woven fabric according to claim 1, wherein the stretchable woven fabric has a basis weight of 1000 $g/m^2$ or less.

14. The stretchable woven fabric according to claim 1, wherein the stretchable woven fabric has a thickness of 0.5 mm or more.

15. The stretchable woven fabric according to claim 1, wherein the stretchable woven fabric has a thickness of 3 mm or less.

* * * * *